US006524075B2

(12) United States Patent
Hwang et al.

(10) Patent No.: US 6,524,075 B2
(45) Date of Patent: Feb. 25, 2003

(54) APPARATUS AND METHOD FOR CONTROLLING OPERATION OF COMPRESSOR

(75) Inventors: Yin Young Hwang, Anyang (KR); Joon Hyung Park, Seoul (KR); Jin Koo Park, Gwangmyeong (KR); Yang Kyu Kim, Seoul (KR); Se Young Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/984,158

(22) Filed: Oct. 29, 2001

(65) Prior Publication Data

US 2002/0064464 A1 May 30, 2002

(30) Foreign Application Priority Data

Nov. 29, 2000 (KR) ..... 00-71656

(51) Int. Cl.[7] ..... F04B 49/06

(52) U.S. Cl. ..... 417/44.11; 417/53; 417/44.1; 417/417; 417/18; 417/212; 417/45

(58) Field of Search ..... 417/53, 44.1, 45, 417/18, 44.11, 212, 417

(56) References Cited

U.S. PATENT DOCUMENTS

| | | | | | |
|---|---|---|---|---|---|
| 4,783,807 | A | * | 11/1988 | Marley | 381/43 |
| 5,947,693 | A | * | 9/1999 | Yang | 417/45 |
| 5,980,211 | A | * | 11/1999 | Tojo et al. | 417/45 |
| 6,084,320 | A | * | 7/2000 | Morita et al. | 310/12 |
| 6,153,951 | A | * | 11/2000 | Morita et al. | 310/12 |
| 6,176,683 | B1 | * | 1/2001 | Yang | 417/44.1 |
| 6,231,310 | B1 | * | 5/2001 | Tojo et al. | 417/44.1 |
| 6,289,680 | B1 | * | 9/2001 | Oh et al. | 62/6 |

* cited by examiner

*Primary Examiner*—Charles G. Freay
*Assistant Examiner*—William H. Rodriguez
(74) *Attorney, Agent, or Firm*—Birch, Stewart, Kolasch & Birch, LLP

(57) ABSTRACT

In an apparatus and a method for controlling operation of a linear compressor, operation of a linear compressor is controlled by finding each inflection point as a TDC (top dead center) is 0 by using a current and a displacement vector generated in the linear compressor, determining a duty ratio on the basis of the inflection point and generating a switching control signal according to the determined duty ratio.

18 Claims, 5 Drawing Sheets

APPARATUS AND METHOD FOR CONTROLLING OPERATION OF COMPRESSOR

BACKGROUND OF THE INVENTION

1. Field of the Invention

The present invention relates to a compressor, and in particular to an apparatus and a method for controlling operation of a compressor which is capable of operating a compressor with an optimum efficiency by using a current and a voltage generated in a compressor.

2. Description of the Prior Art

Generally, because a linear compressor does not include a crankshaft converting a rotation motion into a linear motion, the linear compressor shows a less resistance loss than a resistance loss in a general compressor, accordingly the linear compressor is superior to the general compressor in a compressing efficiency aspect.

When the linear compressor is used for a refrigerator or an air conditioner, a freezing capacity of the refrigerator or the air conditioner can be controlled by varying a compressing ratio of the linear compressor by varying a voltage applied to the linear compressor. The above-mentioned linear compressor will be described with reference to the accompanying FIG. 1.

FIG. 1 is a block diagram illustrating a construction of an apparatus for controlling a linear compressor.

As depicted in FIG. 1, the apparatus for controlling operation of the linear compressor includes a linear compressor 13 varying an internal stroke (not shown) by being inputted a voltage supplied to an internal motor according to a stroke reference value and adjusting a freezing capacity by moving an internal piston up and down, a voltage detecting unit 14 detecting a voltage generated in the linear compressor 13 according to the variation of the stroke, a current detecting unit 14 detecting a voltage generated in the linear compressor 13 according to the variation of the stroke, a microcomputer 15 calculating a stroke by using the voltage detected from the voltage detecting unit 14 and the current detected from the current detecting unit 12, comparing the calculated stroke with a stroke reference value and outputting a switching control signal according to the comparison result, and a power supplying unit 11 supplying a stroke voltage to the linear compressor 13 by transmitting intermittently AC power to the linear compressor with an internal triac TrI according to the switching control signal outputted from the microcomputer 15. Hereinafter, the operation of the apparatus for controlling the linear compressor will be described in detail.

First, the linear compressor 13 varies the stroke by being inputted a voltage supplied to the motor according to the stroke reference value set by a user and adjusts a freezing capacity by moving the piston up and down according to the stroke. Herein, the stroke means a distance in which the piston of the compressor 13 moves while performing a reciprocating motion.

The triac TrI of the power supplying unit 11 has a longer turn on cycle according to the switching control signal outputted from the microcomputer 15, and the AC power is supplied to the linear compressor 31 while the turn on cycle of the triac TrI is lengthened, accordingly the linear compressor operates 31. Herein, the voltage detecting unit 14 and the current detecting unit 12 respectively detect the voltage and the current generated in the linear compressor 13 and respectively output it to the microcomputer 15.

The microcomputer 15 calculates a stroke by using the voltage and the current detected from the voltage detecting unit 14 and the current detecting unit 12, compares the calculated stroke with the stroke reference value and outputs a switching control signal according to it. In more detail, when the calculated stroke is smaller than the stroke reference value, the microcomputer 15 outputs a switching control signal for lengthening on cycle of the triac TrI to the power supplying unit 11 in order to increase a stroke voltage supplied to the linear compressor 13.

On the contrary, when the calculated stroke is larger than the stroke reference value, the microcomputer 15 outputs a switching control signal for shortening on cycle of the triac TrI to the power supplying unit 11 in order to decrease a stroke voltage supplied to the linear compressor 13.

However, in the linear compressor in accordance with the present invention, because the operation of the linear compressor is controlled by comparing the calculated stroke with the stroke reference value and outputting a switching control signal according to it to the power supplying unit, it is impossible to control the operation of the linear compressor accurately. In more detail, because the reciprocating compressor in accordance with the prior art has a serious nonlinearity in the mechanical motion characteristic aspect, it is impossible to perform a precise control of the linear compressor with a control method not considering the nonlinearity.

SUMMARY OF THE INVENTION

Accordingly, it is an object of the present invention to provide an apparatus and a method for controlling operation of a compressor which is capable of controlling operation of a linear compressor precisely and accurately by detecting an inflection point on the basis of a current and a voltage generated in the linear compressor and generating a switching control signal on the basis of the inflection point.

In order to achieve the above-mentioned object, an apparatus for controlling operation of a compressor in accordance with the present invention includes a displacement calculating unit calculating a displacement by using a current and a voltage generated in a compressor, a detecting unit detecting a vector magnitude and a phase signal on the basis of a maximum current vector and a maximum displacement vector having a trace corresponded to the current and the displacement, an inflection point detecting unit detecting a vector magnitude inflection point on the basis of the vector magnitude and a previous detected vector magnitude and a phase inflection point on the basis of the phase signal and a previous detected phase signal, and a duty ratio determining unit controlling the operation of the compressor by comparing the vector magnitude inflection point with the phase inflection point and generating a switching control signal according to it.

In order to achieve the above-mentioned object, a method for controlling operation of a compressor in accordance with the present invention includes calculating a displacement by using a current and a voltage generated in a compressor, detecting a vector magnitude and a phase signal on the basis of a maximum current vector and a maximum displacement vector having a trace corresponded to the current and the displacement, detecting a vector magnitude inflection point on the basis of the vector magnitude and the previous detected vector magnitude and a phase inflection point on the basis of the phase signal and the previous detected phase signal, and controlling the operation of the compressor according to a switching control signal by comparing the vector magnitude inflection point with the phase inflection point and generating the switching control signal according to it.

DETAILED DESCRIPTION OF THE PREFERRED EMBODIMENT

Hereinafter, an apparatus and a method for controlling operation of a linear compressor in accordance with the present invention will be described in detail with reference to accompanying FIGS. 2~6.

Figure 1:
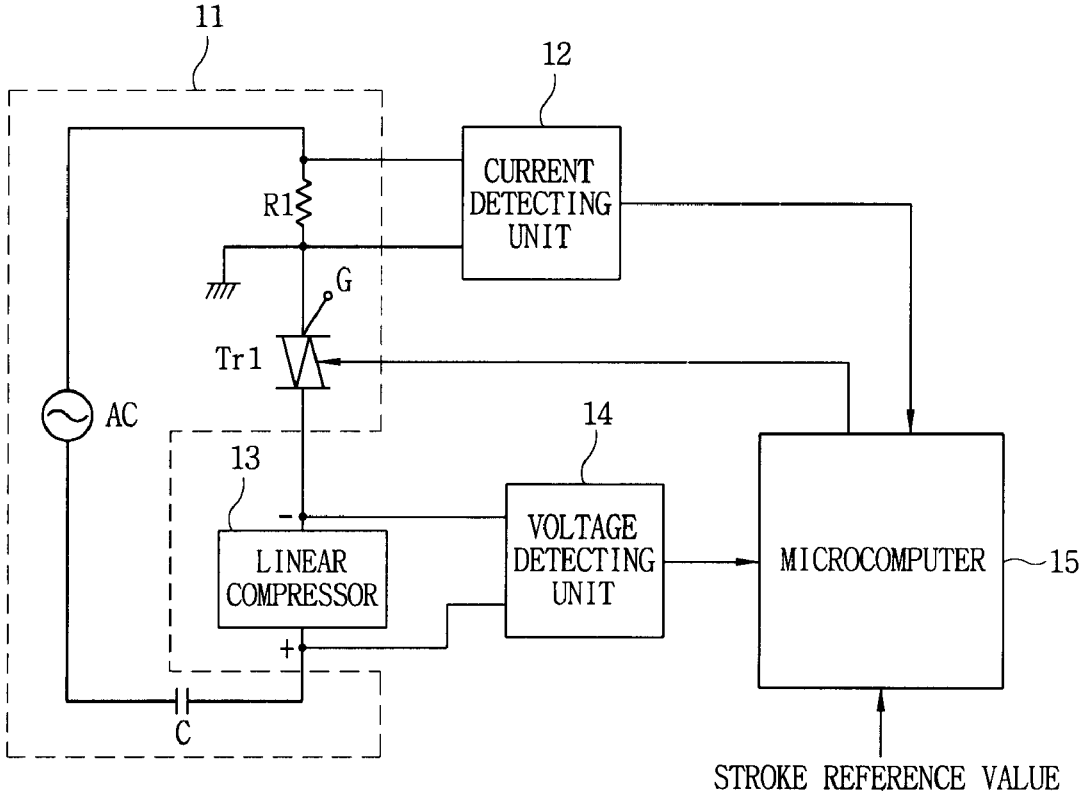
FIG. 1 CONVENTIONAL ART
FIG. 1 is a block diagram illustrating a construction of an apparatus for controlling operation of a linear compressor in accordance with the prior art.
Figure 2:
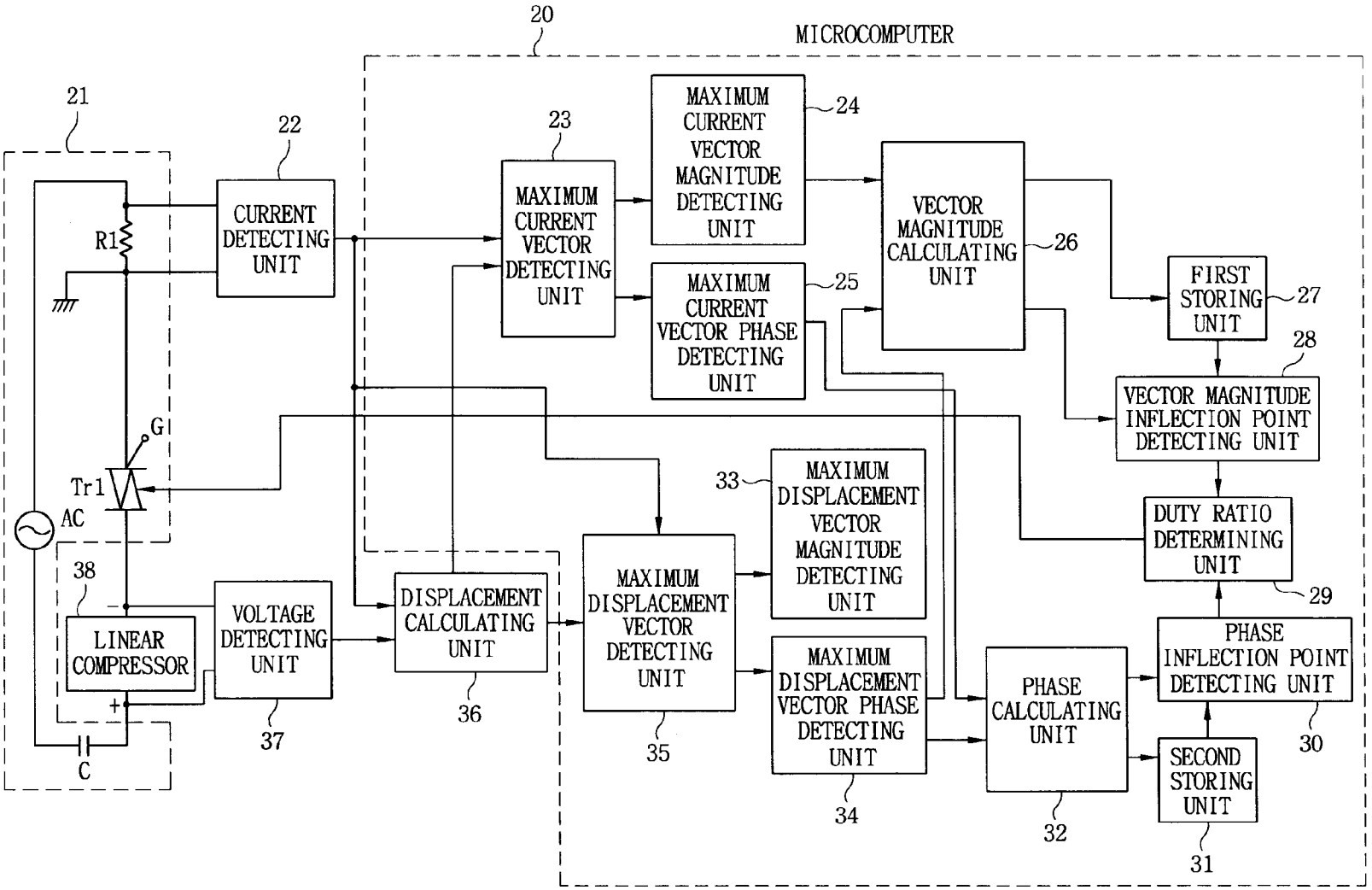
FIG. 2 is a block diagram illustrating a construction of an apparatus for controlling operation of a linear compressor in accordance with the present invention.

FIG. 2 is a block diagram illustrating a construction of an apparatus for controlling operation of a linear compressor in accordance with the present invention.

As depicted in FIG. 2, the apparatus for controlling operation of a linear compressor in accordance with the present invention includes a linear compressor 38 adjusting a freezing capacity by being operated by an operation order of a user and moving an internal piston (not shown) up and down, a voltage detecting unit 37 detecting a voltage generated in the linear compressor 38 according to the operation of the linear compressor 38, a current detecting unit 22 detecting a current generated in the linear compressor 38 according to the operation of the linear compressor 38, a displacement calculating unit 36 calculating a displacement by using the voltage detected from the voltage detecting unit 37 and the current detected from the current detecting unit 22, and a microcomputer 20 detecting a vector magnitude inflection point and a phase inflection point on the basis of the displacement and the current, determining a duty ratio by comparing the detected inflection points and outputting a switching control signal according to the determined duty ratio.

Herein, the microcomputer 20 includes a maximum current vector determining unit 23 detecting a maximum current vector having a trace corresponded to a current detected from the current detecting unit 22 and a displacement calculated in the displacement calculating unit 36 by using the current and the displacement, a maximum displacement vector detecting unit 35 detecting a maximum displacement vector having a trace corresponded to the current and the displacement respectively detected and calculated from the current detecting unit 22 and the displacement calculating unit 36 by using the current and the displacement, a maximum current vector magnitude detecting unit 24 detecting a magnitude of the detected maximum current vector, a maximum current vector phase detecting unit 25 detecting a phase of the detected maximum current vector, a maximum displacement vector magnitude detecting unit 33 detecting a magnitude of the maximum displacement vector, a maximum displacement vector phase detecting unit 34 detecting a phase of the maximum displacement vector, a vector magnitude calculating unit 26 comparing the magnitude of the detected maximum current vector with the magnitude of the detected maximum displacement vector and detecting a vector magnitude according to it, a phase calculating unit 32 comparing the phase of the detected maximum current vector with the phase of the detected maximum displacement vector and detecting a phase signal according to it, a vector magnitude inflection point detecting unit 28 comparing the vector magnitude detected from the vector magnitude calculating unit 26 with a previous detected vector magnitude, detecting a vector magnitude inflection point according to it and outputting a vector magnitude inflection point detecting signal corresponded to the detected vector magnitude inflection point, a phase inflection point detecting unit 30 comparing the phase signal detected from the phase calculating unit 32 with a previous detected phase signal, detecting a phase inflection point according to it and outputting a phase inflection point detecting signal corresponded to the phase inflection point, a duty ratio determining unit 29 determining a duty ratio by being inputted the vector magnitude inflection point detecting signal and the phase inflection point detecting signal and comparing them, and outputting a switching control signal according to the determined duty ratio, and a power supplying unit 21 operating the linear compressor 31 by controlling the operation of the triac according to the switching control signal. Herein, the previous detected vector magnitude and the previous detected phase signal are respectively stored in a first storing unit 27 and a second storing unit 31.

Hereinafter, the operation of the apparatus for controlling operation of the linear compressor in accordance with the present invention will be described in detail with reference to accompanying FIG. 3.

Figure 3:
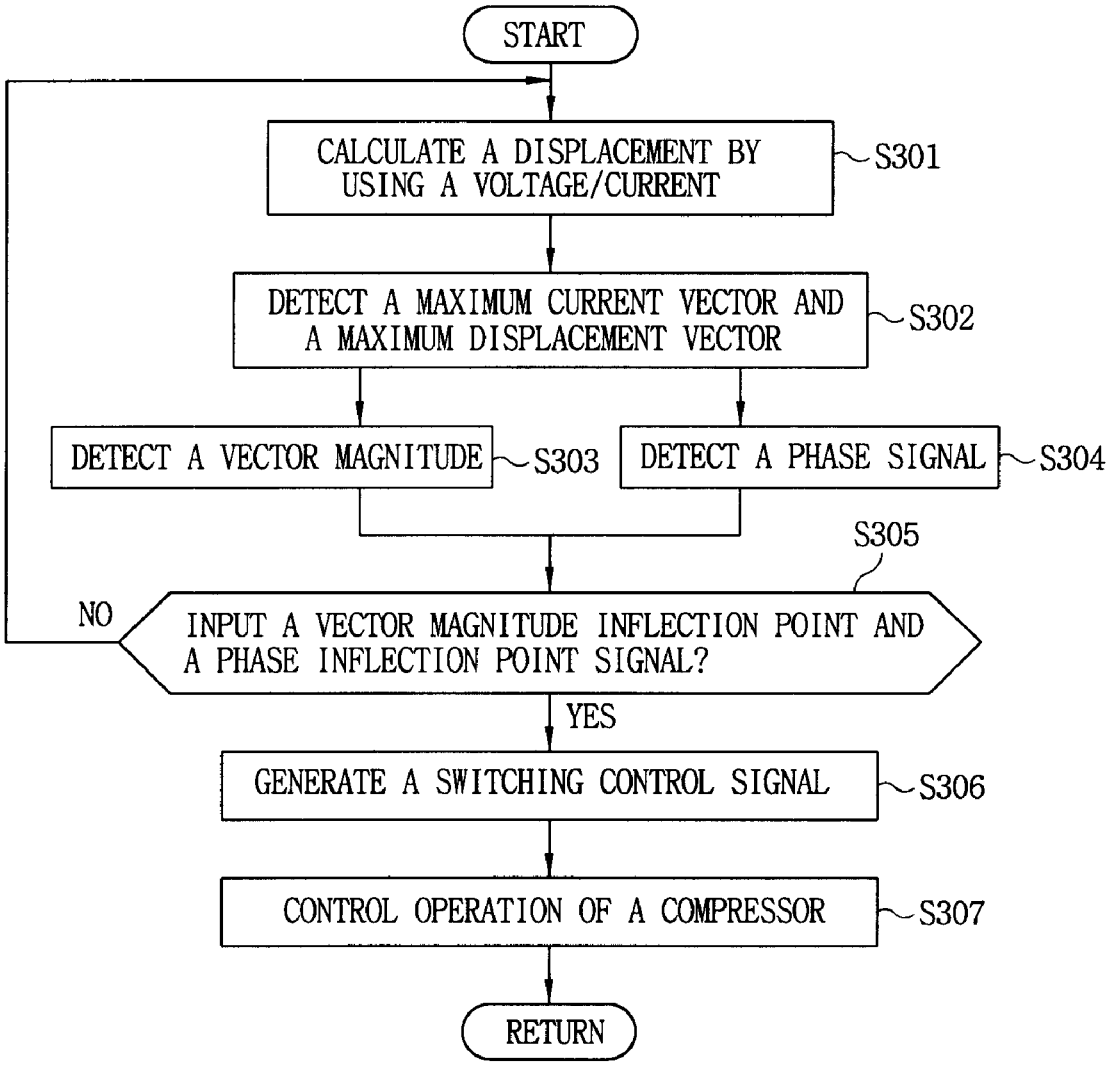
FIG. 3 is a flow chart illustrating operation of the apparatus for controlling operation of the linear compressor in accordance with the present invention.

FIG. 3 is a flow chart illustrating operation of the apparatus for controlling operation of a linear compressor in accordance with the present invention.

First, the linear compressor 38 adjusts a freezing capacity by varying a stroke of the linear compressor 38 according to operation/stop order of a user and moving the piston up and down according to it. Herein, the stroke means a distance in which the piston of the linear compressor 38 moves while performing a reciprocating motion. In more detail, the power supplying unit 21 operates the linear compressor 38 by varying the turn on cycle of the triac TrI according to the switching control signal outputted from the duty ratio determining unit 29.

The voltage determining unit 37 detects the voltage generated in the linear compressor 38 and outputs it to the displacement calculating unit 36. Herein, the current detecting unit 22 detects the current generated in the linear compressor 38 and outputs it to the displacement calculating unit 36.

The displacement calculating unit 36 calculates a displacement by using the voltage detected from the voltage detecting unit 37 and the current detected from the current detecting unit 22 and outputs the calculated displacement to the maximum displacement vector detecting unit 35 as shown at step S301. Herein, the displacement means a stroke value.

The maximum current vector detecting unit 23 detects a maximum current vector having a trace corresponded to the current detected from the current detecting unit 22 and the displacement calculated in the displacement calculating unit 36 and outputs it to the maximum current vector magnitude detecting unit 24 as shown at step S302.

The maximum displacement vector detecting unit 35 detects a maximum displacement vector having a trace corresponded to the current detected from the current detecting unit 22 and the displacement calculated in the displacement calculating unit 36 and outputs it to the maximum displacement vector magnitude detecting unit 33 as shown at step S302.

The maximum current vector magnitude detecting unit 24 detects a magnitude of the maximum current vector outputted from the maximum current vector detecting unit 23 and outputs it to the vector magnitude calculating unit 26 as shown at step S303. Herein, the maximum current vector phase detecting unit 25 detects a phase of the maximum current vector detected from the maximum current vector detecting unit 23 and outputs it to the phase calculating unit 32.

The maximum displacement vector magnitude detecting unit 33 detects a magnitude of the maximum displacement vector outputted form the maximum displacement vector detecting unit 35 and outputs it to the vector magnitude calculating unit 26. Herein, the maximum displacement vector phase detecting unit 34 detects a phase of the maximum displacement vector detected from the maximum displacement vector detecting unit 35 and outputs it to the phase calculating unit 32.

The phase calculating unit 32 detects a phase signal by dividing the phase of the maximum current vector detected from the maximum current vector phase detecting unit 25 by the phase of the maximum displacement vector detected from the maximum displacement vector phase detecting unit 34 and outputs the detected phase signal to the phase inflection point detecting unit 30.

The phase inflection point detecting unit 30 detects a phase inflection point by comparing the phase signal detected from the phase calculating unit 32 with the previous detected phase signal stored in the second storing unit 31 and outputs a phase inflection point corresponded to the detected inflection point to the duty ratio determining unit 29.

In the meantime, the vector magnitude calculating unit 26 calculates a difference between the magnitude of the maximum current vector detected from the maximum current vector magnitude detecting unit 24 and the magnitude of the maximum displacement vector detected from the maximum displacement vector magnitude detecting unit 33, detects a vector magnitude according to the difference, and outputs it to the vector magnitude inflection point detecting unit 28.

The vector magnitude inflection point detecting unit 28 detects the vector magnitude inflection point by comparing the vector magnitude calculated in the vector magnitude calculating unit 26 with the previous detected vector magnitude stored in the first storing unit 27 and outputs a vector magnitude inflection point detecting signal corresponded to the detected inflection point to the duty ratio determining unit 30.

The duty ratio determining unit 30 judges whether the vector magnitude inflection point detecting signal outputted from the vector magnitude inflection point detecting unit 28 and the phase inflection point signal outputted from the phase inflection point detecting unit 30 are inputted as shown at step S305. In more detail, the duty ratio determining unit 30 determines a duty ratio on the basis of the vector magnitude inflection point detected from the vector magnitude inflection point detecting unit 28 and the phase inflection point detected form the phase inflection point detecting unit 30, generates a switching control signal according to the determined duty ratio and outputs it to the power supplying unit 21 as shown at step S306.

The power supplying unit 21 controls the operation of the linear compressor 31 by controlling the on/off cycle of the triac TrI according to the switching control signal outputted from the duty ratio determining unit 30 as shown at step S307.

Figure 4:
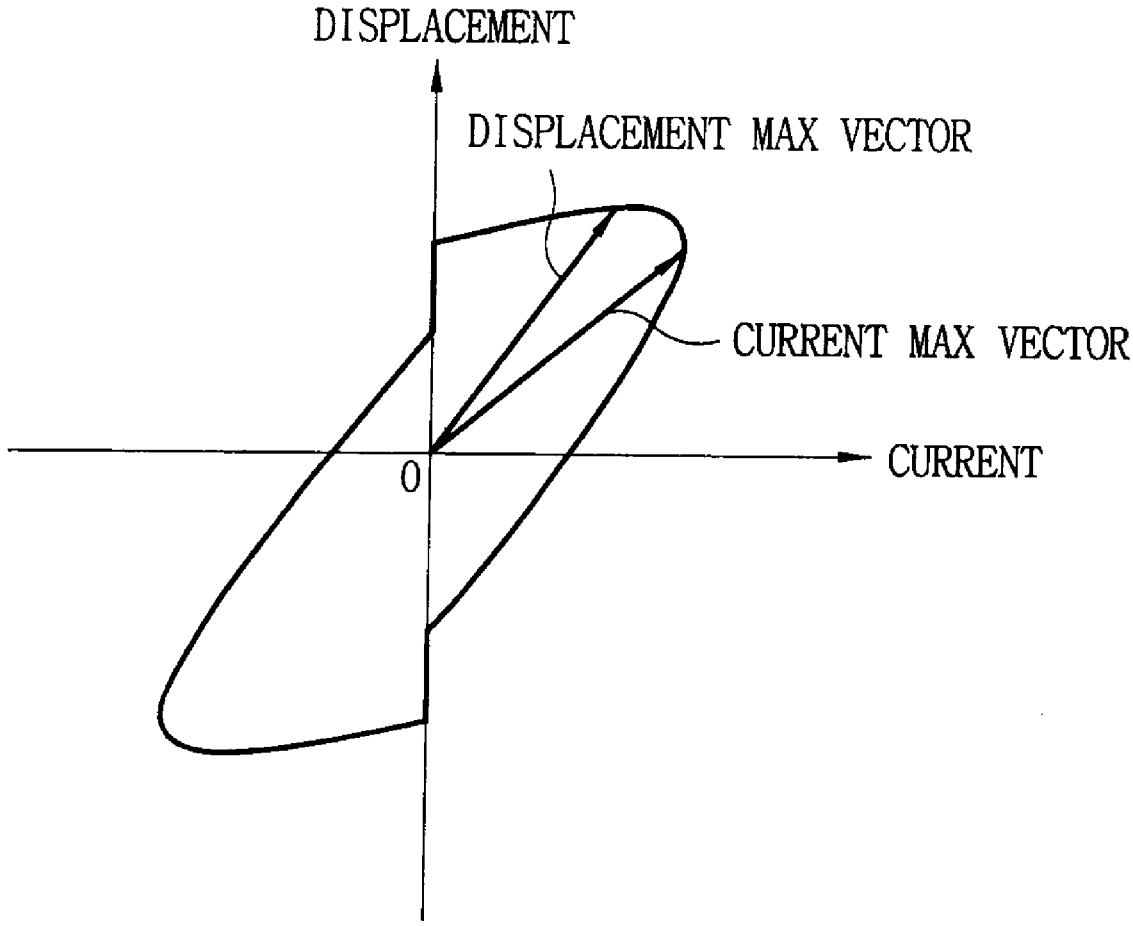
FIG. 4 illustrates a corresponding relation of a current and a displacement generated in the apparatus for controlling operation of the linear compressor in accordance with the present invention.

FIG. 4 illustrates a corresponding relation of a current and a displacement generated in the apparatus for controlling operation of the linear compressor in accordance with the present invention. In more detail, it illustrates a maximum current vector and a maximum displacement vector having a trace corresponded to the current detected from the current detecting unit 22 and the displacement calculated in the displacement calculating unit 36.

Figure 5:
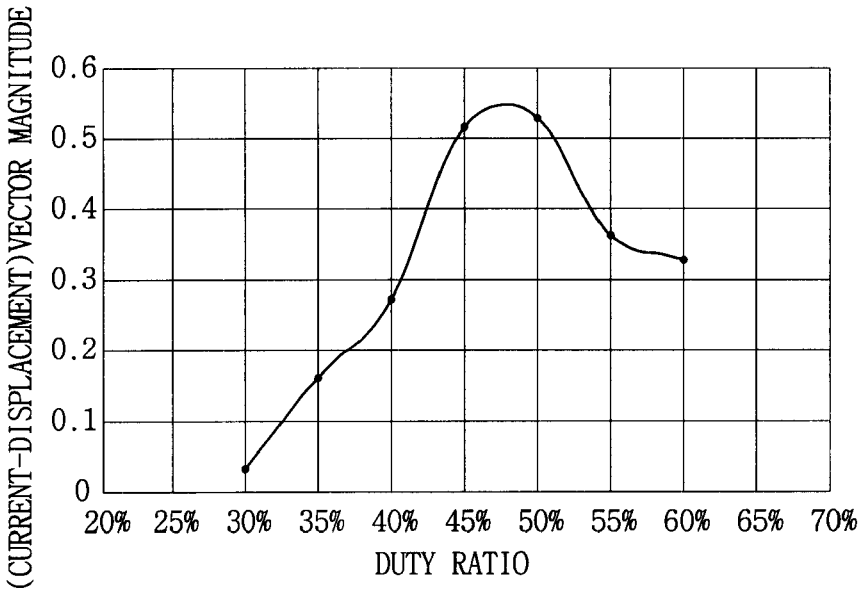
FIG. 5 illustrates variation of a vector magnitude signal according to increase of a duty ratio of a switching control signal generated in the apparatus for controlling operation of the linear compressor in accordance with the present invention.

FIG. 5 illustrates variation of a vector magnitude signal according to increase of a duty ratio of a switching control signal generated in the apparatus for controlling operation of a linear compressor in accordance with the present invention. In more detail, in the test result of the present invention, a region occurred the vector magnitude inflection point is a point as a TDC (top dead center) of the piston of the linear compressor 31 is '0'.

Figure 6:
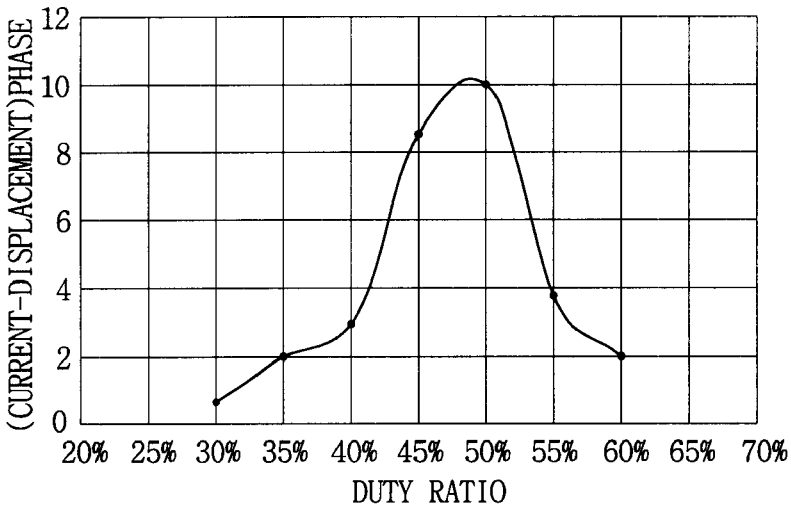
FIG. 6 illustrates variation of a phase signal according to increase of duty-ratio of a switching control signal generated in the apparatus for controlling operation of the linear compressor in accordance with the present invention.

FIG. 6 illustrates variation of a phase signal according to increase of duty-ratio of a switching control signal generated in the apparatus for controlling operation of a linear compressor in accordance with the present invention. In more detail, in the test result of the present invention, a region occurred the phase inflection point is a point as a TDC (top dead center) of the piston of the linear compressor 31 '0'.

Accordingly, in the present invention, the operation of the linear compressor 31 is controlled by calculating a vector magnitude inflection point and a phase inflection point as the TDC is '0' by using the current and displacement vector generated in the linear compressor 31, determining a duty ratio on the basis of the inflection points and controlling an on/off cycle of the triac TrI with a switching control signal according to the determined duty ratio. In more detail, in the apparatus and the method for controlling the operation of the linear compressor in accordance with the present invention, the operation of the linear compressor can be controlled precisely and accurately by controlling the operation of the linear compressor 31 with a linear method considering a serious nonlinearity of the linear compressor in the mechanical motion characteristic aspect.

As described above, in the apparatus and the method for controlling the operation of the linear compressor in accordance with the present invention, the operation efficiency of the linear compressor 31 can be improved by using the current and the displacement vector generated in the linear compressor 31, calculating a vector magnitude inflection point and a phase inflection point as the TDC is '0', generating a switching control signal on the basis of the inflection points and controlling the operation of the linear compressor 31.

What is claimed is:

1. An apparatus for controlling operation of a linear compressor, comprising:

a displacement calculating unit calculating a displacement by using a current and a voltage generated in a compressor;

a detecting unit detecting a vector magnitude and a phase signal on the basis of a maximum current vector and a maximum displacement vector having a trace corresponded to the current and the displacement;

an inflection point detecting unit detecting a vector magnitude inflection point on the basis of the vector magnitude and a previous detected vector magnitude and a phase inflection point on the basis of the phase signal and a previous detected phase signal; and a duty ratio determining unit controlling the operation of the compressor by comparing the vector magnitude inflection point with the phase inflection point and generating a switching control signal according to it.

2. The apparatus of claim 1, wherein the compressor is operated according to the switching control signal.

3. The apparatus of claim 1, further comprising:

a power supplying unit operating the compressor by controlling on/off operation of a triac according to the switching control signal.

4. The apparatus of claim 2, wherein the power supplying unit supplies the stroke voltage by controlling the on/off cycle of the triac according to the switching control signal.

5. The apparatus of claim 1, wherein the compressor is a linear compressor.

6. The apparatus of claim 1, wherein the vector magnitude is detected by calculating a difference between the maximum current vector and the maximum displacement vector.

7. The apparatus of claim 1, wherein the switching control signal is generated according to a duty ratio determined on the basis of the vector magnitude inflection point and the phase inflection point.

8. The apparatus of claim 1, wherein the first and the second inflection points are points in which a TDC (top dead center) is 0.

9. The apparatus of claim 1, wherein the detecting unit detects the phase signal by dividing the maximum current vector by the maximum displacement vector.

10. A method for controlling operation of a linear compressor, comprising:

calculating a displacement by using a current and a voltage supplied in a compressor;

detecting a vector magnitude and a phase signal on the basis of a maximum current vector and a maximum displacement vector having a trace corresponded to the current and the displacement;

detecting a vector magnitude inflection point by comparing the vector magnitude with a previous detected vector magnitude and a phase inflection point by comparing the phase signal with a previous detected phase signal; and controlling the operation of the compressor according to a switching control signal by comparing the vector magnitude inflection point with the phase inflection point and generating the switching control signal according to it.

11. The method of claim 10, wherein the compressor is a linear compressor.

12. The method of claim 10, wherein the vector magnitude is detected by calculating a difference between the maximum current vector and the maximum displacement vector.

13. The method of claim 10, wherein the switching control signal is generated according to a duty ratio determined on the basis of the vector magnitude inflection point and the phase inflection point.

14. The method of claim 10, wherein the vector magnitude inflection point and the phase inflection point are points in which a TDC (top dead center) is 0.

15. The method of claim 10, wherein the phase signal is detected by dividing the maximum current vector by the maximum displacement vector.

16. An apparatus for controlling operation of a linear compressor, comprising:

a displacement calculating unit calculating a displacement by using a current and a voltage generated in a linear compressor;

a maximum current vector detecting unit detecting a maximum current vector having a trace corresponded to the current and the displacement;

a maximum displacement vector detecting unit detecting a maximum displacement vector having a trace corresponded to the current and the displacement;

a vector magnitude calculating unit calculating a vector magnitude by calculating a difference between the maximum current vector and the maximum displacement vector;

a phase calculating unit calculating a phase signal by dividing the maximum current vector by the maximum displacement vector;

a vector magnitude inflection point detecting unit detecting a vector magnitude inflection point by comparing the vector magnitude with a previous detected vector magnitude;

a phase inflection point detecting unit detecting a phase inflection point by comparing the phase signal with a previous detected phase signal;

a duty ratio determining unit outputting a switching control signal on the basis of the vector magnitude inflection point and the phase inflection point; and a power supplying unit operating the linear compressor according to the switching control signal.

17. The apparatus of claim 16, wherein the power supplying unit operates the linear compressor by controlling an on/off cycle of a triac according to the switching control signal.

18. The apparatus of claim 16, wherein the switching control signal is generated according to a duty ratio determined on the basis of the vector magnitude inflection point and the phase inflection point.

* * * * *